US010293983B1

(12) United States Patent
Kaplan

(10) Patent No.: US 10,293,983 B1
(45) Date of Patent: May 21, 2019

(54) GARBAGE BAG SET AND ASSOCIATED USE THEREOF

(71) Applicant: Trish Kaplan, Newport Beach, CA (US)

(72) Inventor: Trish Kaplan, Newport Beach, CA (US)

( * ) Notice: Subject to any disclaimer, the term of this patent is extended or adjusted under 35 U.S.C. 154(b) by 314 days.

(21) Appl. No.: 15/347,583

(22) Filed: Nov. 9, 2016

Related U.S. Application Data

(60) Provisional application No. 62/253,103, filed on Nov. 9, 2015.

(51) Int. Cl.

| | |
|---|---|
| ***B65D 33/00*** | (2006.01) |
| ***B65F 1/00*** | (2006.01) |
| ***B65D 33/28*** | (2006.01) |
| ***B65F 1/06*** | (2006.01) |
| ***B65F 1/14*** | (2006.01) |
| ***B65D 75/52*** | (2006.01) |

(52) U.S. Cl.
CPC ..... *B65D 33/001* (2013.01); *B65D 33/28* (2013.01); *B65D 75/527* (2013.01); *B65F 1/002* (2013.01); *B65F 1/062* (2013.01); *B65F 1/14* (2013.01); *B65F 2250/114* (2013.01)

(58) Field of Classification Search
CPC .... B65D 33/001; B65D 33/28; B65D 75/527; B65F 1/002; B65F 1/062; B65F 1/14
USPC ..... 383/37; 220/495.07, 495.11
See application file for complete search history.

(56) References Cited

U.S. PATENT DOCUMENTS

| | | | | |
|---|---|---|---|---|
| 3,076,579 | A * | 2/1963 | Kuhlman | A47G 19/03 220/495.07 |
| 3,888,406 | A * | 6/1975 | Nippes | B65F 1/062 206/554 |
| 5,363,980 | A * | 11/1994 | Mulcahy | B65F 1/00 206/554 |
| 6,679,398 | B1 * | 1/2004 | O'Brien | B44D 3/12 220/495.02 |
| 7,080,750 | B2 * | 7/2006 | Wein | B65F 1/062 220/495.01 |
| 8,887,941 | B2 * | 11/2014 | Heintzman | B65D 25/14 220/495.06 |
| 2007/0045326 | A1 * | 3/2007 | Tramontina | B65F 1/0006 220/495.11 |
| 2007/0045483 | A1 * | 3/2007 | Johnson | B65F 1/0006 248/99 |
| 2017/0088349 | A1 * | 3/2017 | Patel | B65F 1/0006 |

FOREIGN PATENT DOCUMENTS

| | | | | |
|---|---|---|---|---|
| JP | 07315502 | A * | 12/1995 | B65F 1/062 |

* cited by examiner

*Primary Examiner* — Jes F Pascua
(74) *Attorney, Agent, or Firm* — Ashkan Najafi

(57) ABSTRACT

A garbage bag set for improving trash maintenance and management. The garbage bag set includes a plurality of detachably interconnected garbage bags configured to be simultaneously seated within an existing trash receptacle. Such detachably interconnected garbage bags include at least a first garbage bag and a second garbage bag wherein the first garbage bag is removably lined with the second garbage bag. In this manner, the detachably interconnected garbage bags are coextensively shaped. The detachably interconnected garbage bags are further configured such that the first garbage bag is detached from the second garbage bag while the second garbage bag remains seated within the existing trash receptacle.

13 Claims, 6 Drawing Sheets

GARBAGE BAG SET AND ASSOCIATED USE THEREOF

CROSS REFERENCE TO RELATED APPLICATIONS

This is a non-provisional patent application that claims the benefit of U.S. provisional patent application No. 62/253,103 filed Nov. 9, 2015, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to trash bags and, more particularly, to a garbage bag set that features a plurality of separate bags, interconnected so that when one is full, the next bag is already lining the garbage receptacle thereby improving trash maintenance and management.

Prior Art

For most Americans, the daily disposal of garbage is a necessary fact of life. Empty milk jugs, food containers, clothing tags, used razor blades, orange peels, scraps of paper and soda pop bottles are but just a few of the items tossed in the trash every day. By far, the United States leads the world in garbage disposal. In fact, according to a recent study compiled by the Environmental Protection Agency (EPA) the average American discards an astonishing 4.4 pounds of trash daily, with 40% of this garbage being produced in the kitchen. It is safe to say that almost everyone produces garbage. Because of this, the vast majority of households are equipped with at least one, or several, garbage cans. Produced in a variety of sizes, garbage cans are usually found in kitchens, bathrooms, bedrooms, laundry rooms, and garages, offering consumers an easy means of collecting waste. Most consumers find that lining their garbage cans with disposable plastic trash bags reduces the mess associated with the collection of waste. Trash bags are particularly useful because they keep the interior of the garbage can clean and free of debris. This is especially important in the kitchen, where leaky cartons of milk, egg shells and bits of food can quickly grow moldy and emit a foul odor when left to collect in the bottom of a trash can.

Although trash bags are a necessary and practical item, for many consumers there can be drawbacks to their use. Specifically, it can be taxing to continuously change out garbage bags. This is especially true in households with large families, where a typical kitchen bag can be filled so quickly that it is sometimes necessary to empty the garbage as much as twice a day. Such frequency can result in users inadvertently forgetting to reline a can, and the next person who goes to discard an item is greeted with the annoying and frustrating sight of a bag-less can.

Additionally, finding ample storage space for clean trash bags can be a nuisance. Packaged in oversized cardboard boxes, a container of large outdoor garbage bags, or even a roll of small kitchen bags, can take up a great deal of valuable storage space within a utility closet or underneath the sink. For the countless consumers who fill their cabinets and closets to the brim with cleaning supplies, groceries and other items, finding room for and accessing their stored garbage bags for use when needed can be difficult.

Accordingly, a need remains for a garbage bag set in order to overcome at least one aforementioned shortcoming. The exemplary embodiment(s) satisfy such a need by providing a garbage bag set that features a plurality of separate bags, interconnected so that when one is full, the next bag is already lining the garbage receptacle that is convenient and easy to use, lightweight yet durable in design, versatile in its applications, and designed for improving trash maintenance and management.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a garbage bag set for improving trash maintenance and management. These and other objects, features, and advantages of the non-limiting exemplary embodiment(s) are provided by a garbage bag set including a plurality of detachably interconnected garbage bags configured to be simultaneously seated within an existing trash receptacle. Such detachably interconnected garbage bags include at least a first garbage bag and a second garbage bag wherein the first garbage bag is removably lined with the second garbage bag. In this manner, the detachably interconnected garbage bags are coextensively shaped. The detachably interconnected garbage bags are further configured such that the first garbage bag is detached from the second garbage bag while the second garbage remains seated within the existing trash receptacle.

In a non-limiting exemplary embodiment, the first garbage bag includes a first open top end having a first top peripheral edge extending along an entire perimeter of the first open top end. The first top peripheral edge includes a first pull tab provided with a first shoulder offset and exposed to an ambient atmosphere. A first line of weakness is disposed along a major longitudinal length of the first top peripheral edge. Advantageously, a first pull cord is detachably connected to the first top peripheral edge and extended along the first line of weakness. Such a first pull cord is configured to remain exposed to the ambient atmosphere while the first garbage bag is connected to the second garbage bag.

In a non-limiting exemplary embodiment, the second garbage bag includes a second open top end having a second top peripheral edge extending along an entire perimeter of the second open top end. Such a second top peripheral edge includes a second pull tab provided with a second shoulder offset and exposed to an ambient atmosphere. A second line of weakness is disposed along a major longitudinal length of the second top peripheral edge. Advantageously, a second pull cord is detachably connected to the second top peripheral edge and extended along the second line of weakness. Such a second pull cord is configured to remain exposed to the ambient atmosphere while remaining ones of the garbage bags are seated within the existing trash receptacle.

In a non-limiting exemplary embodiment, each of the first pull tab and the second pull tab is configured to remain exposed to the ambient atmosphere while the first garbage bag is interconnected to the second garbage bag.

In a non-limiting exemplary embodiment, each of the first pull cord and the second pull cord is disposed along a respective interior surface of the first garbage bag and the second garbage bag, respectively.

In a non-limiting exemplary embodiment, each of the first pull cord and the second pull cord is configured to be entirely detached from the first line of weakness and the second line of weakness, respectively.

In a non-limiting exemplary embodiment, the first pull tab is configured to be located adjacent to the second pull tab while the first pull cord is connected to the first line of weakness. The first pull tab and the second pull tab are configured to remain aligned along a linear segment of the first top peripheral edge and the second top peripheral edge, respectively, while the first garbage bag and the second garbage bag are seated within the existing trash receptacle.

In a non-limiting exemplary embodiment, the first pull tab is integrally formed with the first top peripheral edge of the first garbage bag, the second pull tab is configured to remain exposed to the ambient atmosphere when the first pull tab is detached from the first garbage bag.

In a non-limiting exemplary embodiment, the first garbage bag and the second garbage bag include a first draw string and a second draw string respectively located adjacent to the first open top end and the second open top end, respectively.

The present disclosure further includes, a method of utilizing a garbage bag set for improving trash maintenance and management. Such a method includes the steps of: providing a trash receptacle; and providing a plurality of detachably interconnected garbage bags including at least a first garbage bag and a second garbage bag. Such detachably interconnected garbage bags are coextensively shaped wherein the first garbage bag is removably lined with the second garbage bag.

The method further includes the steps of: simultaneously seating the detachably interconnected garbage bags within an existing trash receptacle; and detaching the first garbage bag from the second garbage bag while the second garbage remains seated within the existing trash receptacle.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
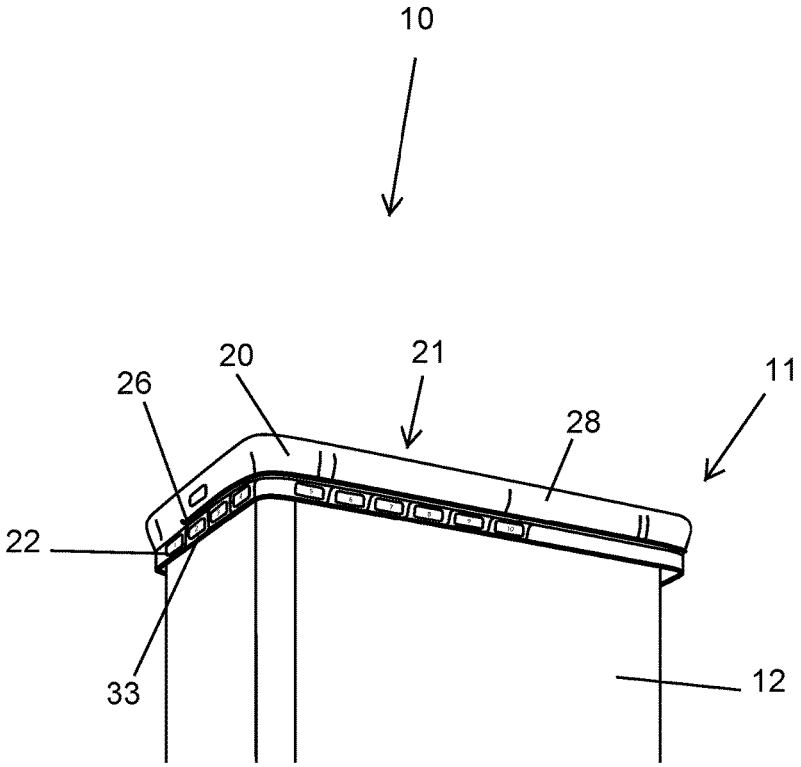
FIG. 1 is a perspective view of a garbage bag set showing the first garbage bag interconnected to the second garbage bag, in accordance with a non-limiting exemplary embodiment.
Figure 2:
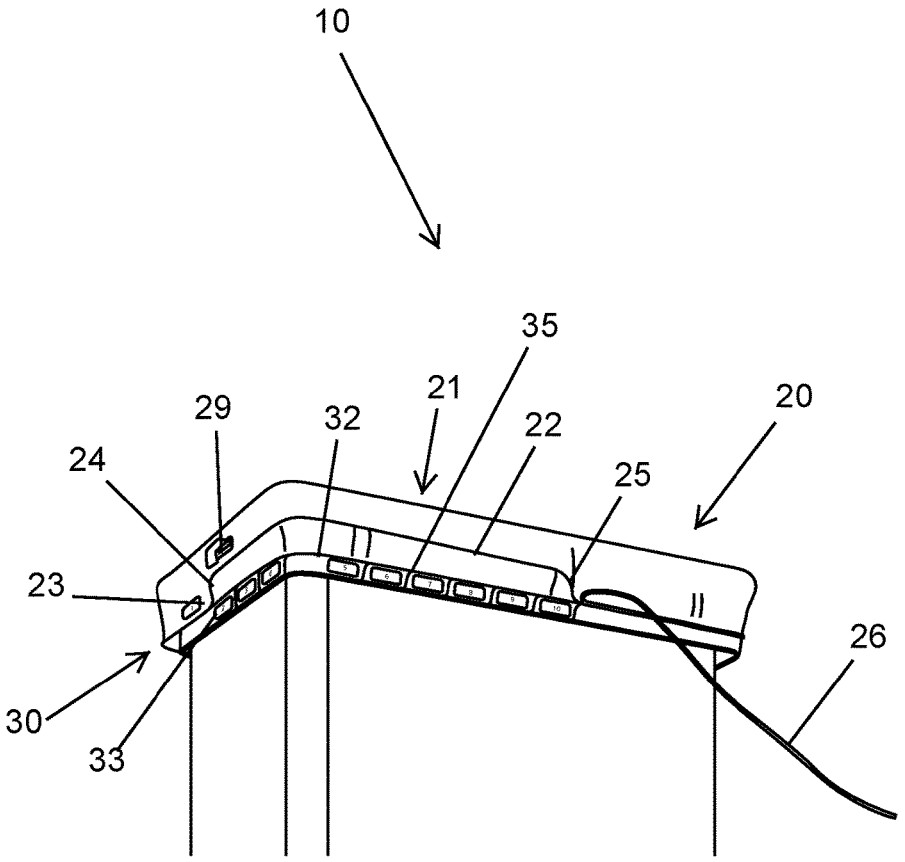
FIG. 2 is a perspective view showing the first garbage bag partially detached from the second garbage bag.
Figure 3:
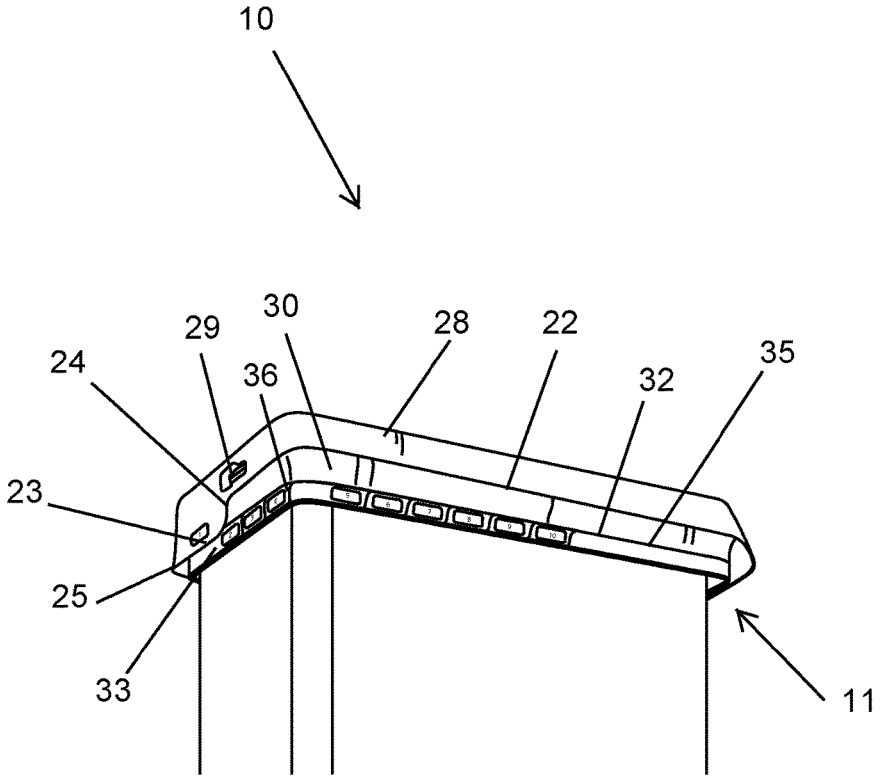
FIG. 3 is a perspective view showing the first pull cord completely removed from the first peripheral top edge of the first garbage bag.
Figure 4:
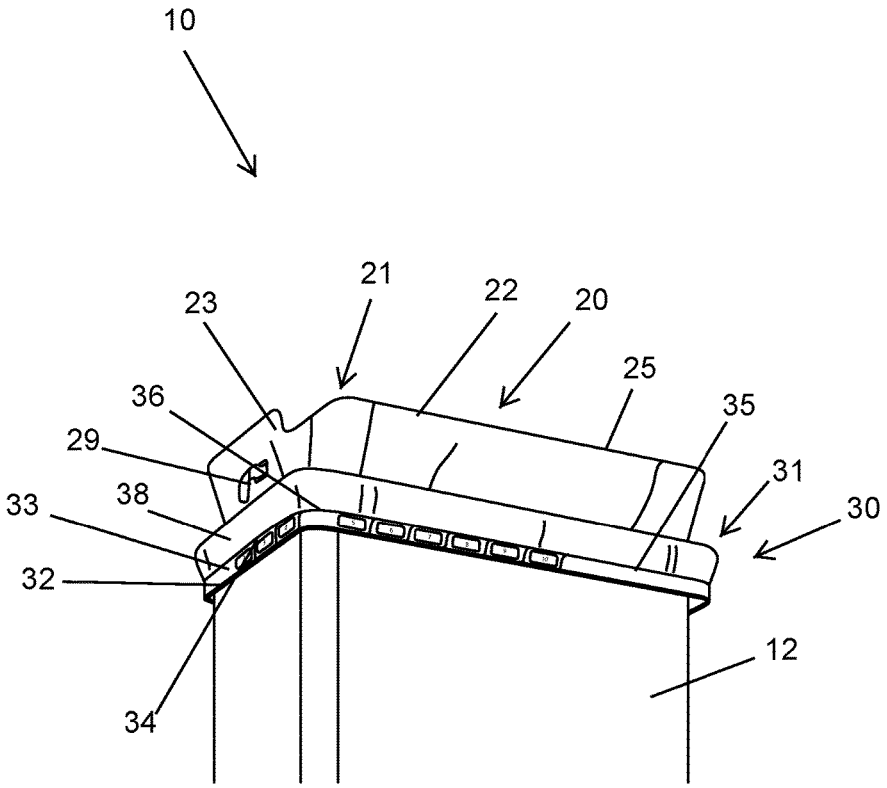
FIG. 4 is a perspective view showing the first peripheral top edge of the first garbage bag lifted up and away from the second garbage bag.
Figure 5:
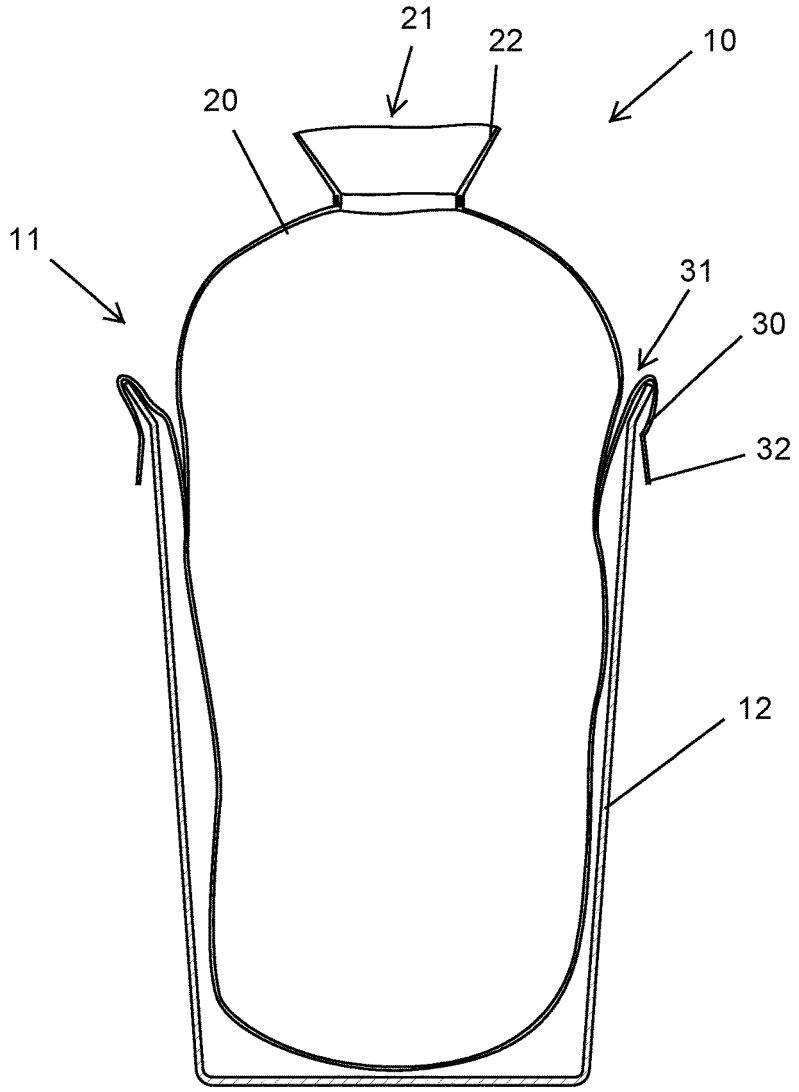
Figure 6:
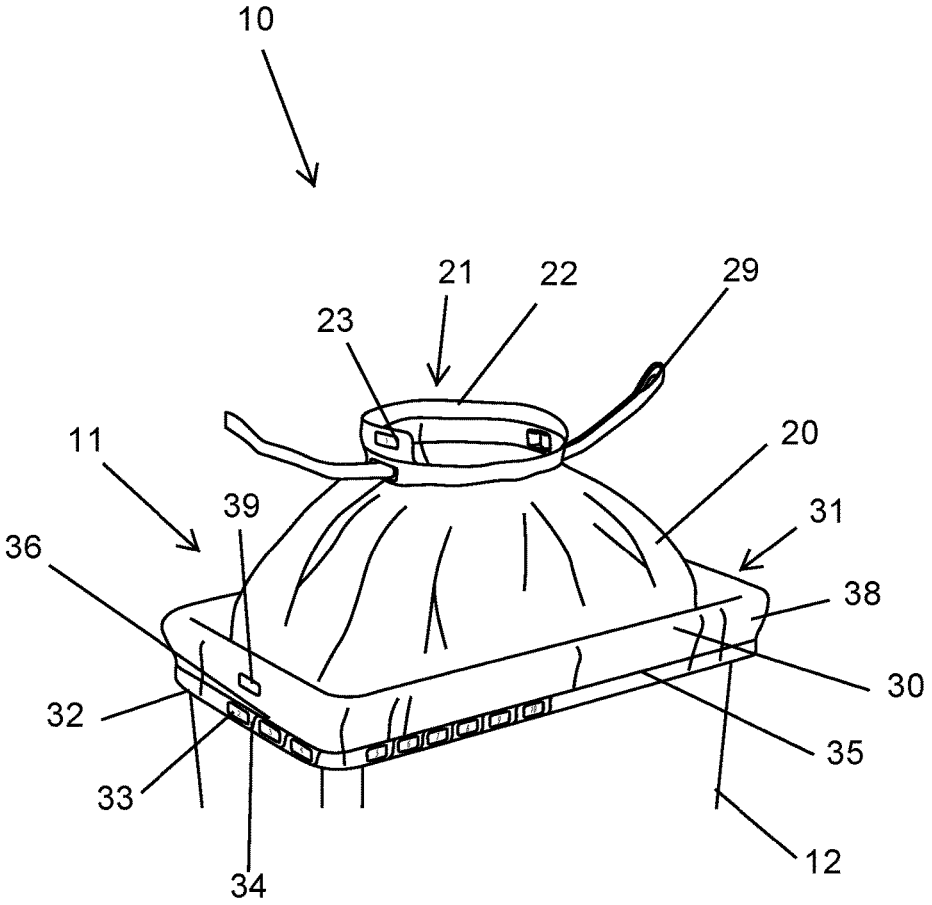

FIG. 5 is a cross-sectional view showing the first open top end of the first garbage bag partially closed and ready to be lifted out from the trash receptacle while the second garbage bag remains at an initial resting position within the trash receptacle; and FIG. 6 is a perspective view showing the first open top end of the first garbage bag partially closed and ready to be lifted out from the trash receptacle while the second garbage bag remains at an initial resting position within the trash receptacle.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

The non-limiting exemplary embodiment(s) is/are referred to generally in FIGS. 1-6 and is/are intended to provide a garbage bag set 10 for improving trash maintenance and management. The garbage bag set 10 advantageously features a plurality of separate bags 11, interconnected so that when one is full, the next bag is already lining the garbage receptacle 12 thereby improving trash maintenance and management. It should be understood that the exemplary embodiment(s) may be used to line a variety of garbage cans, and should not be limited to any particular type of garbage can described herein.

Referring to FIGS. 1-6, the garbage bag set 10 includes a plurality of detachably interconnected garbage bags 11 configured to be simultaneously seated within an existing trash receptacle 12. Such detachably interconnected garbage bags 11 include at least a first garbage bag 20 and a second garbage bag 30 wherein the first garbage bag 20 is removably lined with the second garbage bag 30. In this manner, the detachably interconnected garbage bags 11 are coextensively shaped. The detachably interconnected garbage bags 11 are further configured such that the first garbage bag 20 is detached from the second garbage bag 30 while the second garbage bag 30 remains seated within the existing trash receptacle 12.

In a non-limiting exemplary embodiment, the first garbage bag 20 includes a first open top end 21 having a first top peripheral edge 22 extending along an entire perimeter of the first open top end 21. The first top peripheral edge 22 includes a first pull tab 23 provided with a first shoulder 24 offset and exposed to an ambient atmosphere. A first line of weakness 25 is disposed along a major longitudinal length of the first top peripheral edge 22. Advantageously, a first pull cord 26 is detachably connected to the first top peripheral edge 22 and extended along the first line of weakness 25. Such a first pull cord 26 is configured to remain exposed to the ambient atmosphere while the first garbage bag 20 is connected to the second garbage bag 30.

In a non-limiting exemplary embodiment, the second garbage bag 30 includes a second open top end 31 having a second top peripheral edge 32 extending along an entire perimeter of the second open top end 31. Such a second top peripheral edge 32 includes a second pull tab 33 provided with a second shoulder 34 offset and exposed to an ambient atmosphere. A second line of weakness 35 is disposed along a major longitudinal length of the second top peripheral edge 32. Advantageously, a second pull cord 36 is detachably connected to the second top peripheral edge 32 and extended along the second line of weakness 35. Such a second pull cord 36 is configured to remain exposed to the ambient atmosphere while remaining ones of the garbage bags 11 are seated within the existing trash receptacle 12.

In a non-limiting exemplary embodiment, each of the first pull tab 23 and the second pull tab 33 is configured to remain exposed to the ambient atmosphere while the first garbage bag 20 is interconnected to the second garbage bag 30.

In a non-limiting exemplary embodiment, each of the first pull cord 26 and the second pull cord 36 is disposed along a respective interior surface 28, 38 of the first garbage bag 20 and the second garbage bag 30, respectively.

In a non-limiting exemplary embodiment, each of the first pull cord 26 and the second pull cord 36 is configured to be entirely detached from the first line of weakness 25 and the second line of weakness 35, respectively.

In a non-limiting exemplary embodiment, the first pull tab 23 is configured to be located adjacent to the second pull tab 33 while the first pull cord 26 is connected to the first line of weakness 25. The first pull tab 23 and the second pull tab 33 are configured to remain aligned along a linear segment of the first top peripheral edge 22 and the second top peripheral edge 32, respectively, while the first garbage bag 20 and the second garbage bag 30 are seated within the existing trash receptacle 12.

In a non-limiting exemplary embodiment, the first pull tab 23 is integrally formed with the first top peripheral edge 22 of the first garbage bag 20, the second pull tab 33 is configured to remain exposed to the ambient atmosphere when the first pull tab 23 is detached from the first garbage bag 20.

In a non-limiting exemplary embodiment, the first garbage bag 20 and the second garbage bag 30 include a first draw string 29 and a second draw string 39 respectively located adjacent to the first open top end 21 and the second open top end 31, respectively.

The present disclosure further includes, a method of utilizing a garbage bag set 10 for improving trash maintenance and management. Such a method includes the steps of: providing a trash receptacle 12; and providing a plurality of detachably interconnected garbage bags 11 including at least a first garbage bag 20 and a second garbage bag 30. Such detachably interconnected garbage bags 11 are coextensively shaped wherein the first garbage bag 20 is removably lined with the second garbage bag 30.

The method further includes the steps of: simultaneously seating the detachably interconnected garbage bags 11 within an existing trash receptacle 12; and detaching the first garbage bag 20 from the second garbage bag 30 while the second garbage remains seated within the existing trash receptacle 12.

Referring to the figures in general, in a non-limiting exemplary embodiment(s), the garbage bag set 10 is envisioned as a group of garbage bags 11 that are comprised of a plurality of separate garbage bags (e.g., garbage bags 20, 30) interconnected as one unit. In this manner, a trash receptacle 12 is lined with multiple bags at once, so that when one is full, it can be removed and a replacement bag is already installed to collect more garbage. The garbage bag set 10 could be fabricated of a durable, biodegradable, two- or three-ply polyethylene plastic material and offered in sizes ranging from wastebasket small to extra-large, thirty-gallon capacity.

In a non-limiting exemplary embodiment, the bags 11 may be based on standard tall kitchen bags infused with a fresh, clean scent woven through the plastic material and slowly released as each bag is put to use. The clever combination of multiple bags as one unit provides several advantages. For example, twenty (or more) bags 20, 30, etc. are stacked flush against one another, and joined at the top of the collection with a perforation (e.g., line of weakness). For easy separation, a red zipper tab (e.g., pull tab) is incorporated at the top of each bag. Extremely effective, the garbage bag set 10 is employed in a matter of seconds. Removing the unit from its folded state in its outer packaging, the user simply unfolds the unit, shakes it out, and lines the trash receptacle 12. When the first bag 20 is full, the user pulls the red pull tab 23 ("zip") to separate the first bag 20 from the second bag 30, and removes and ties the first bag 20 for disposal ("grip"). As a result, at least nineteen bags remain ready for use until the last bag is full.

There are many significant benefits and advantages associated with the garbage bag set 10. Foremost, this cleverly designed product offers consumers a more convenient means of utilizing as well as storing garbage bags 11. Creatively combining at least 20 garbage bags (e.g., liners) into one unit, for example, the garbage bag set 10 handily eliminates the hassles inherent in changing out garbage bags 11. With a simple "zip and grip," full bags can be removed, leaving behind an installed liner that is immediately available for collection. As such, one never needs worry about encountering a bag-less can. A space saver, use of the garbage bag set 10 provides a practical alternative to storing garbage bags 11 in overcrowded cupboards, cabinets, and closets. Placed directly in the trash receptacle 12, the garbage bag set 10 ensures that clean garbage bags (e.g., 20, 30) were always at one's fingertips.

Easily accessed, the unique configuration also enables consumers to quickly and conveniently replace used bags with a fresh, clean garbage bag in a manner of seconds. Manufactured in a variety of sizes and even colors, the garbage bag set 10 is well suited for use in bathrooms, kitchens, and garages. Perfect for home use, professional cleaning services, businesses, restaurants and office establishments should also appreciate the many advantages this useful product affords.

The garbage bag set 10 is an innovative product which offers consumers a unique and clever means of managing household garbage. Simple to use, this functional product is a valuable accessory in any home or business establishment.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A garbage bag set for improving trash maintenance and management, said garbage bag set comprising:

a plurality of detachably interconnected garbage bags configured to be simultaneously seated within an existing trash receptacle, said detachably interconnected garbage bags including at least a first garbage bag and a second garbage bag, said first garbage bag being removably lined with said second garbage bag, said detachably interconnected garbage bags further being configured such that said first garbage bag is detached from said second garbage bag while said second garbage bag remains seated within the existing trash receptacle;

wherein said first garbage bag comprises a first open top end having a first top peripheral edge extending along an entire perimeter of said first open top end, said first top peripheral edge including a first pull tab provided with a first shoulder offset and exposed to an ambient atmosphere;

a first line of weakness disposed along a major longitudinal length of said first top peripheral edge; and a first pull cord detachably connected to said first top peripheral edge and extended along said first line of weakness, said first pull cord being configured to remain exposed to the ambient atmosphere while said first garbage bag is connected to said second garbage bag;

wherein said second garbage bag comprises a second open top end having a second top peripheral edge extending along an entire perimeter of said second open top end, said second open top peripheral edge including a second pull tab provided with a second shoulder offset and exposed to an ambient atmosphere;

a second line of weakness disposed along a major longitudinal length of said second top peripheral edge; and a second pull cord detachably connected to said second top peripheral edge and extended along said second line of weakness, said second pull cord being configured to remain exposed to the ambient atmosphere while remaining ones of said garbage bags are seated within the existing trash receptacle;

wherein said first pull tab is configured to be located adjacent to said second pull tab while said first pull cord is connected to said first line of weakness, said first pull tab and said second pull tab being configured to remain aligned along a linear segment of said first top peripheral edge and said second top peripheral edge, respectively, while said first garbage bag and said second garbage bag are seated within the existing trash receptacle.

2. The garbage bag set of claim 1, wherein each of said first pull tab and said second pull tab is configured to remain exposed to the ambient atmosphere while said first garbage bag is interconnected to said second garbage bag.

3. The garbage bag set of claim 1, wherein each of said first pull cord and said second pull cord is disposed along a respective interior surface of said first garbage bag and said second garbage bag, respectively.

4. The garbage bag set of claim 1, wherein each of said first pull cord and said second pull cord is configured to be entirely detached from said first line of weakness and said second line of weakness, respectively.

5. The garbage bag set of claim 1, wherein said first pull tab is integrally formed with said first top peripheral edge of said first garbage bag, said second pull tab is configured to remain exposed to the ambient atmosphere when said first pull tab is detached from said first garbage bag.

6. The garbage bag set of claim 1, wherein said first garbage bag and said second garbage bag comprise: a first draw string and a second draw string respectively located adjacent to said first open top end and said second open top end, respectively.

7. A garbage bag set for improving trash maintenance and management, said garbage bag set comprising:

a plurality of detachably interconnected garbage bags configured to be simultaneously seated within an existing trash receptacle, said detachably interconnected garbage bags including at least a first garbage bag and a second garbage bag, said first garbage bag being removably lined with said second garbage bag, said detachably interconnected garbage bags further being configured such that said first garbage bag is detached from said second garbage bag while said second garbage bag remains seated within the existing trash receptacle;

wherein said detachably interconnected garbage bags are coextensively shaped;

wherein said first garbage bag comprises a first open top end having a first top peripheral edge extending along an entire perimeter of said first open top end, said first top peripheral edge including a first pull tab provided with a first shoulder offset and exposed to an ambient atmosphere;

a first line of weakness disposed along a major longitudinal length of said first top peripheral edge; and a first pull cord detachably connected to said first top peripheral edge and extended along said first line of weakness, said first pull cord being configured to remain exposed to the ambient atmosphere while said first garbage bag is connected to said second garbage bag;

wherein said second garbage bag comprises a second open top end having a second top peripheral edge extending along an entire perimeter of said second open top end, said second open top peripheral edge including a second pull tab provided with a second shoulder offset and exposed to an ambient atmosphere;

a second line of weakness disposed along a major longitudinal length of said second top peripheral edge; and a second pull cord detachably connected to said second top peripheral edge and extended along said second line of weakness, said second pull cord being configured to remain exposed to the ambient atmosphere while remaining ones of said garbage bags are seated within the existing trash receptacle;

wherein said first pull tab is integrally formed with said first top peripheral edge of said first garbage bag, said second pull tab is configured to remain exposed to the ambient atmosphere when said first pull tab is detached from said first garbage bag.

8. The garbage bag set of claim 7, wherein each of said first pull tab and said second pull tab is configured to remain exposed to the ambient atmosphere while said first garbage bag is interconnected to said second garbage bag.

9. The garbage bag set of claim 7, wherein each of said first pull cord and said second pull cord is disposed along a respective interior surface of said first garbage bag and said second garbage bag, respectively.

10. The garbage bag set of claim 7, wherein each of said first pull cord and said second pull cord is configured to be entirely detached from said first line of weakness and said second line of weakness, respectively.

11. The garbage bag set of claim 7, wherein said first pull tab is configured to be located adjacent to said second pull tab while said first pull cord is connected to said first line of weakness, said first pull tab and said second pull tab being configured to remain aligned along a linear segment of said first top peripheral edge and said second top peripheral edge, respectively, while said first garbage bag and said second garbage bag are seated within the existing trash receptacle.

12. The garbage bag set of claim 7, wherein said first garbage bag and said second garbage bag comprise: a first draw string and a second draw string respectively located adjacent to said first open top end and said second open top end, respectively.

13. A method of utilizing a garbage bag set for improving trash maintenance and management, said method comprising the steps of:

providing a trash receptacle;

providing a plurality of detachably interconnected garbage bags including at least a first garbage bag and a second garbage bag, said detachably interconnected garbage bags being coextensively shaped wherein said first garbage bag is removably lined with said second garbage bag;

simultaneously seating said detachably interconnected garbage bags within an existing trash receptacle; and detaching said first garbage bag from said second garbage bag while said second garbage bag remains seated within the existing trash receptacle;

wherein said first garbage bag comprises a first open top end having a first top peripheral edge extending along an entire perimeter of said first open top end, said first top peripheral edge including a first pull tab provided with a first shoulder offset and exposed to an ambient atmosphere;

a first line of weakness disposed along a major longitudinal length of said first top peripheral edge; and a first pull cord detachably connected to said first top peripheral edge and extended along said first line of weakness, said first pull cord being configured to remain exposed to the ambient atmosphere while said first garbage bag is connected to said second garbage bag;

wherein said second garbage bag comprises a second open top end having a second top peripheral edge extending along an entire perimeter of said second open top end, said second open top peripheral edge including a second pull tab provided with a second shoulder offset and exposed to an ambient atmosphere;

a second line of weakness disposed along a major longitudinal length of said second top peripheral edge; and a second pull cord detachably connected to said second top peripheral edge and extended along said second line of weakness, said second pull cord being configured to remain exposed to the ambient atmosphere while remaining ones of said garbage bags are seated within the existing trash receptacle;

wherein said first pull tab is integrally formed with said first top peripheral edge of said first garbage bag, said second pull tab is configured to remain exposed to the ambient atmosphere when said first pull tab is detached from said first garbage bag.

* * * * *